US007413276B2

(12) United States Patent
Garcia et al.

(10) Patent No.: US 7,413,276 B2
(45) Date of Patent: Aug. 19, 2008

(54) DIAGNOSTIC FOR VISUAL DETECTION OF MEDIA ADVANCE ERRORS

(75) Inventors: Joan Manuel Garcia, Barcelona (ES); Francesc Subirada, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 1315 days.

(21) Appl. No.: 09/941,884

(22) Filed: Aug. 28, 2001

(65) Prior Publication Data

US 2003/0048320 A1 Mar. 13, 2003

(51) Int. Cl.
*B41J 29/393* (2006.01)

(52) U.S. Cl. ..... 347/19; 347/9; 347/16

(58) Field of Classification Search ..... 347/7, 347/10, 11, 12, 19, 16, 41, 42, 43, 40
See application file for complete search history.

(56) References Cited

U.S. PATENT DOCUMENTS 4,916,638 A * 4/1990 Haselby et al. ..... 264/159
5,992,962 A * 11/1999 Yen et al. ..... 347/9
6,076,915 A * 6/2000 Gast et al. ..... 347/19
6,089,695 A * 7/2000 Takagi et al. ..... 347/40
6,137,592 A * 10/2000 Arquilevich et al. ..... 358/1.8
6,164,750 A 12/2000 Subirada et al. ..... 347/19
6,196,736 B1 * 3/2001 Otsuki et al. ..... 400/124.01
6,334,659 B1 * 1/2002 Maeda et al. ..... 347/12
6,398,334 B2 * 6/2002 Dunand ..... 347/14
6,428,227 B2 * 8/2002 Petteruti et al. ..... 400/691
6,450,606 B1 * 9/2002 Kato et al. ..... 347/19

* cited by examiner

*Primary Examiner*—Lam S Nguyen

(57) ABSTRACT

A diagnostic technique allows an easy visual detection of poor media advance calibration. The diagnostic technique employs a print mode that prints different areas of the plot at different passes with a controlled amount of advances between them. The dot positioning error in the different areas has a non-systematic nozzle contribution, that tends to cancel out, and a systematic contribution due to the accumulative media advance error. Different patterns can be used to make the dot positioning error due to the accumulative media advance error show up. By increasing the number of media advances between the printing of sets of pixels, e.g. pixels in a horizontal line, the effect of accumulated errors and the apparent visual effect is increased.

8 Claims, 12 Drawing Sheets

110

| | | | |
|---|---|---|---|
| 1 | 1 | 4 | 4 |
| 1 | 1 | 4 | 4 |
| 2 | 2 | 1' | 1' |
| 2 | 2 | 1' | 1' |
| 3 | 3 | 2' | 2' |
| 3 | 3 | 2' | 2' |
| 4 | 4 | 3' | 3' |
| 4 | 4 | 3' | 3' |

FIG. 10A

100

| | | | | |
|---|---|---|---|---|
| 5 | 6 | 4 | 7 | 1 |
| 7 | 1 | 3 | 2 | 4 |
| 5 | 8 | 7 | 6 | 3 |
| 7 | 4 | 1 | 8 | 2 |
| 8 | 3 | 2 | 5 | 4 |

FIG. 9

DIAGNOSTIC FOR VISUAL DETECTION OF MEDIA ADVANCE ERRORS

TECHNICAL FIELD OF THE DISCLOSURE

This invention relates to inkjet printers, and more particularly to techniques for detecting media advance errors.

BACKGROUND OF THE DISCLOSURE

Large scale plotters typically support roll-form print media, i.e., a supply of paper or transparent film on a roll. The media is loaded into the printer, and is advanced along a media path to a print area. A swath-type printer includes a carriage mounted for scanning movement along a swath axis, transverse to the media path at the print area. Hereafter, the media path is known as the X-axis, and the scanning or swath axis is the Y-axis. For color printing, the carriage holds a plurality of ink-jet printheads, each for printing a different color ink, typically black, cyan, magenta and yellow. The printer includes a media drive mechanism for moving the media along the media path, and a carriage drive mechanism for scanning the carriage along the scan axis. The printer controller issues print control signals to cause the printheads to eject droplets of ink in a controlled manner to form a desired image or plot on the medium.

Ink-jet printing is based on accurate ballistic delivery of small ink droplets to exact locations onto the paper or other media. Typically the droplet placement occurs onto a grid of different resolutions, most common grids being 300×300 dpi or 600×600 dpi, although other solutions are continuously being considered. One key factor for sharp and high quality images stems from the accuracy of the droplet placement.

There are several contributors to droplet placement inaccuracies. Some of these arise from the printer and some other from the printhead. They can occur along the scan axis or the media path directions. Some inaccuracies are systematic, while some others follow random patterns.

Several factors contribute to error in paper/media movements. The media roll is typically mounted in the printer on an axis or spindle. The spindle is prevented from turning at idle by a friction brake. This creates "back-tension" which helps the media auto-alignment. The media auto-alignment process includes X-axis movements, i.e. movements along the media advance direction, and rotations of the paper to prevent skew and mispositioning of the paper on the print zone. These movements create some undesirable paper slip on the print zone that negatively affect dot placement. These errors affect both printing and also dot placement calibration.

Some other movements have been detected when advancing the paper with back-tension. These movements are due to irregularities on the pinch-wheels as well as different pressures between pinch-wheels and roller and media tensions along the X-axis.

The reliable detection of media advance errors has traditionally been a hard problem, and a critical step in the process of finding the root causes of poor image quality. With the decrease of drop volume, the increase of the printing resolution, and the growing sophistication of the imaging pipeline, image quality problems are becoming increasingly difficult to track down. They are in many cases caused by subtle interactions between print masks, nozzle directionality problems, and media advance. Finding ways of decoupling the effect of possible root causes of poor image quality has become an important issue, both for internal development and for helping system users in a trouble-shooting process.

SUMMARY OF THE DISCLOSURE

This disclosure is directed to a diagnostic technique that allows an easy visual detection of poor media advance calibration, which can be utilized by users (implemented in the trouble-shooting process of printers) and in printer development.

The diagnostic technique employs a print mode that prints different areas of the plot at different passes with a controlled amount of advances between them; the dot positioning error in the different areas has a non-systematic nozzle contribution, that tends to cancel out, and a systematic contribution due to the accumulative media advance error. Different patterns can be used to make the dot positioning error due to the accumulative media advance error show up.

An aspect is to increase the number of media advances between the printing of sets of pixels, e.g. pixels in a horizontal line, thereby increasing the effect of accumulated errors and the apparent visual effect.

BRIEF DESCRIPTION OF THE DRAWING

These and other features and advantages of the present invention will become more apparent from the following detailed description of an exemplary embodiment thereof, as illustrated in the accompanying drawings, in which:

FIG. 9 depicts an exemplary print mask.

FIG. 10A depicts a mask for a four pass print mode.

DETAILED DESCRIPTION OF THE DISCLOSURE

Exemplary embodiments of this invention will be described with respect to large format printers, although the invention can also be practiced on other types of printers.

Commonly assigned U.S. Pat. No. 5,835,108, entitled CALIBRATION TECHNIQUE FOR MISDIRECTED INKJET PRINTHEAD NOZZLES, describes an exemplary large format color inkjet printer/plotter which can employ the recent invention. FIGS. 1-8 and the following description of these figures are generally taken from this patent, the entire contents of which are incorporated herein by this reference.

Figure 1:
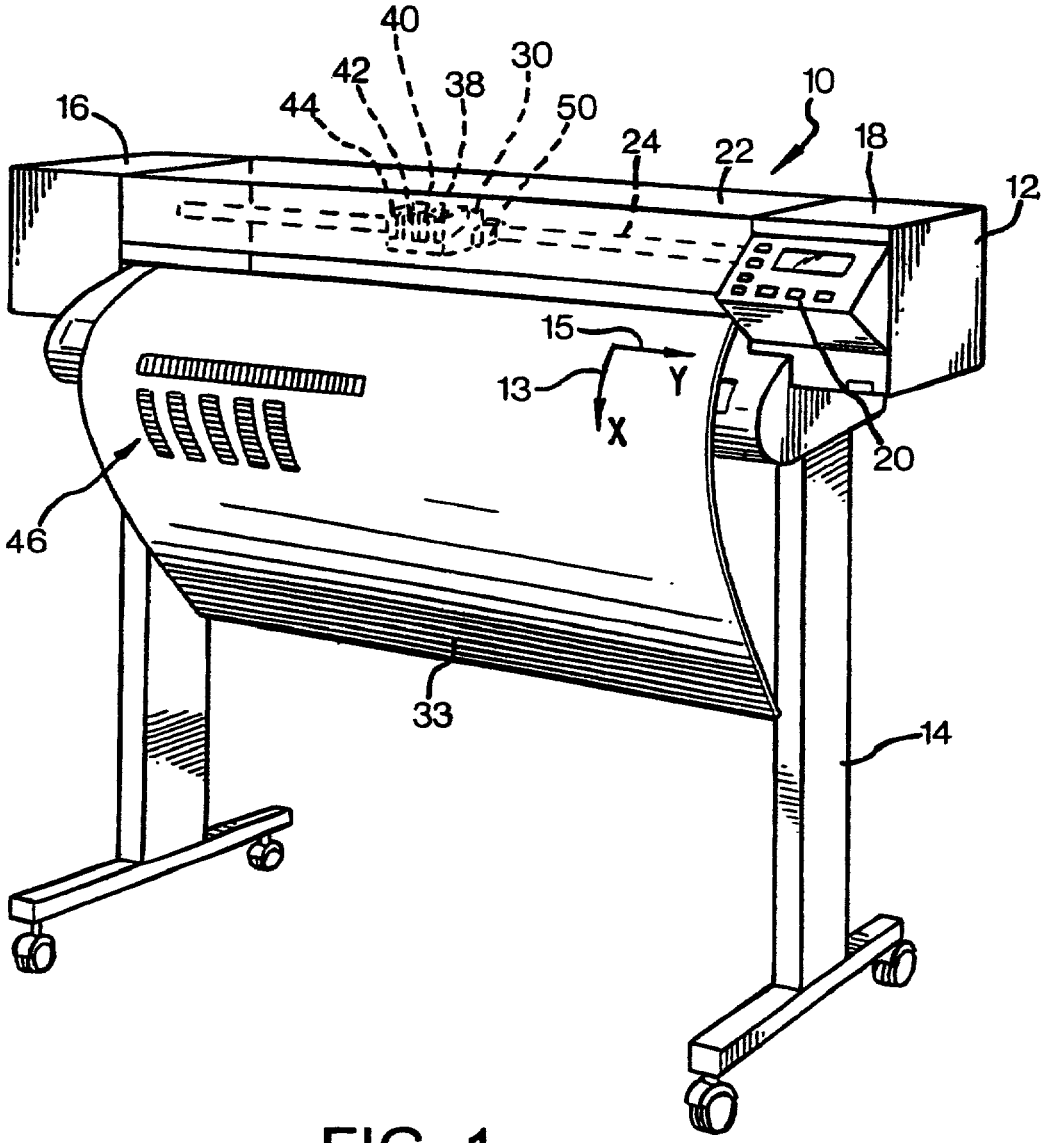
FIG. 1 is a perspective view of a large format inkjet printer/plotter.

FIG. 1 is a perspective view of an inkjet printer/plotter 10 having a housing 12 mounted on a stand 14. The housing has left and right drive mechanism enclosures 16 and 18. A control panel 20 is mounted on the right enclosure 18. A carriage assembly 30, illustrated in phantom under a cover 22, is adapted for reciprocal motion along a carriage bar 24, also shown in phantom. The position of the carriage assembly 30 in a horizontal or carriage scan axis is determined by a carriage positioning mechanism 31 with respect to an encoder strip 32 (see FIG. 2). A print medium 33 such as paper is positioned along a vertical or media axis by a media axis drive mechanism (not shown). As used herein, the media axis is called the X axis denoted as 13, and the scan axis is called the Y axis denoted as 15.

Figure 2:
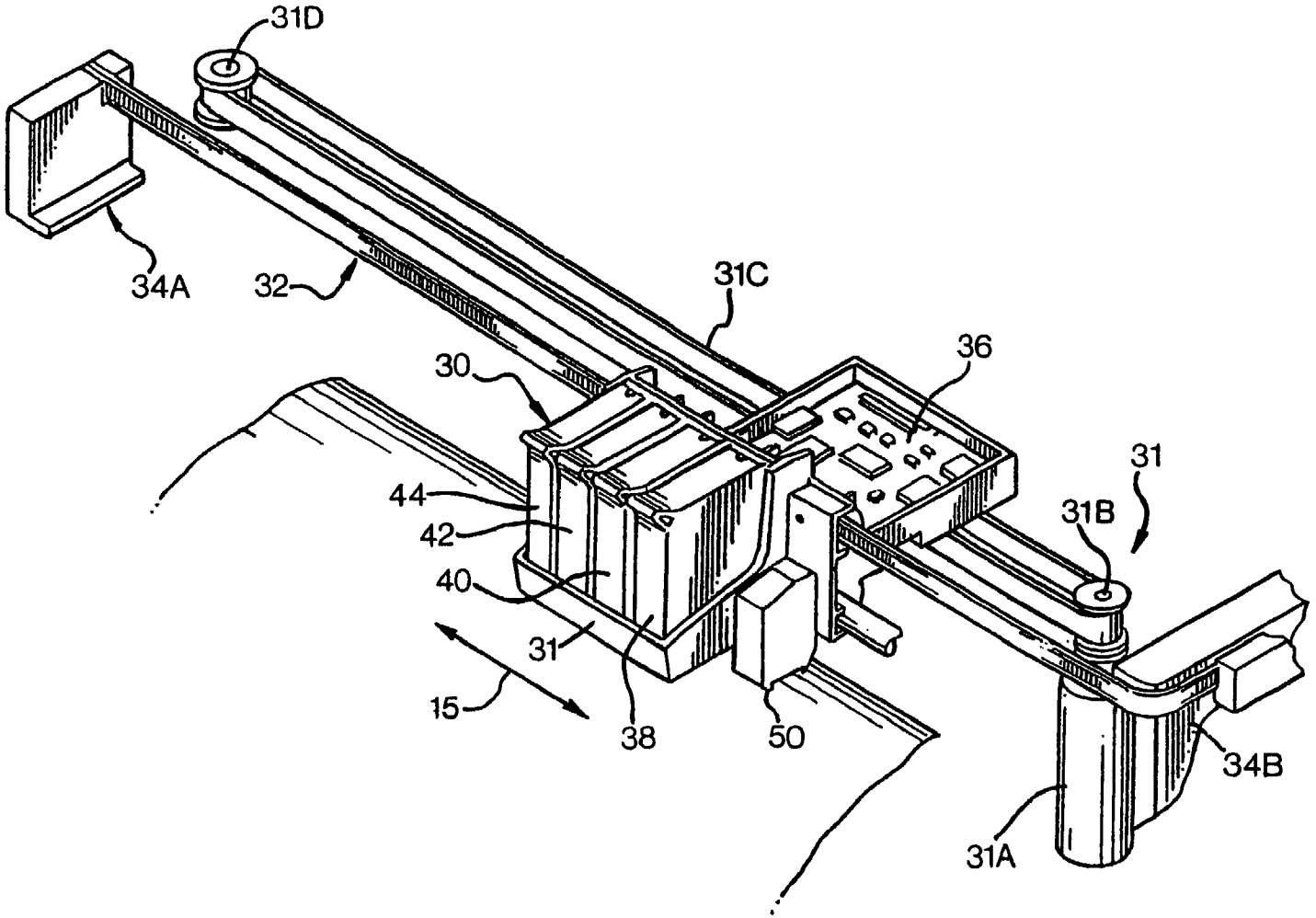
FIG. 2 is a close-up view of the carriage portion of the printer/plotter of FIG. 1 showing a carriage-mounted optical sensor.

FIG. 2 is a perspective view of the carriage assembly 30, the carriage positioning mechanism 31 and the encoder strip 32. The carriage positioning mechanism 31 includes a carriage position motor 31A which has a shaft 31B which drives a belt 31C which is secured by idler 31D and which is attached to the carriage 30.

The position of the carriage assembly in the scan axis is determined precisely by the encoder strip 32. The encoder strip 32 is secured by a first stanchion 34A on one end and a second stanchion 34B on the other end. An optical reader (not shown) is disposed on the carriage assembly and provides carriage position signals which are utilized by the invention to achieve image registration in the manner described below.

Figure 3:
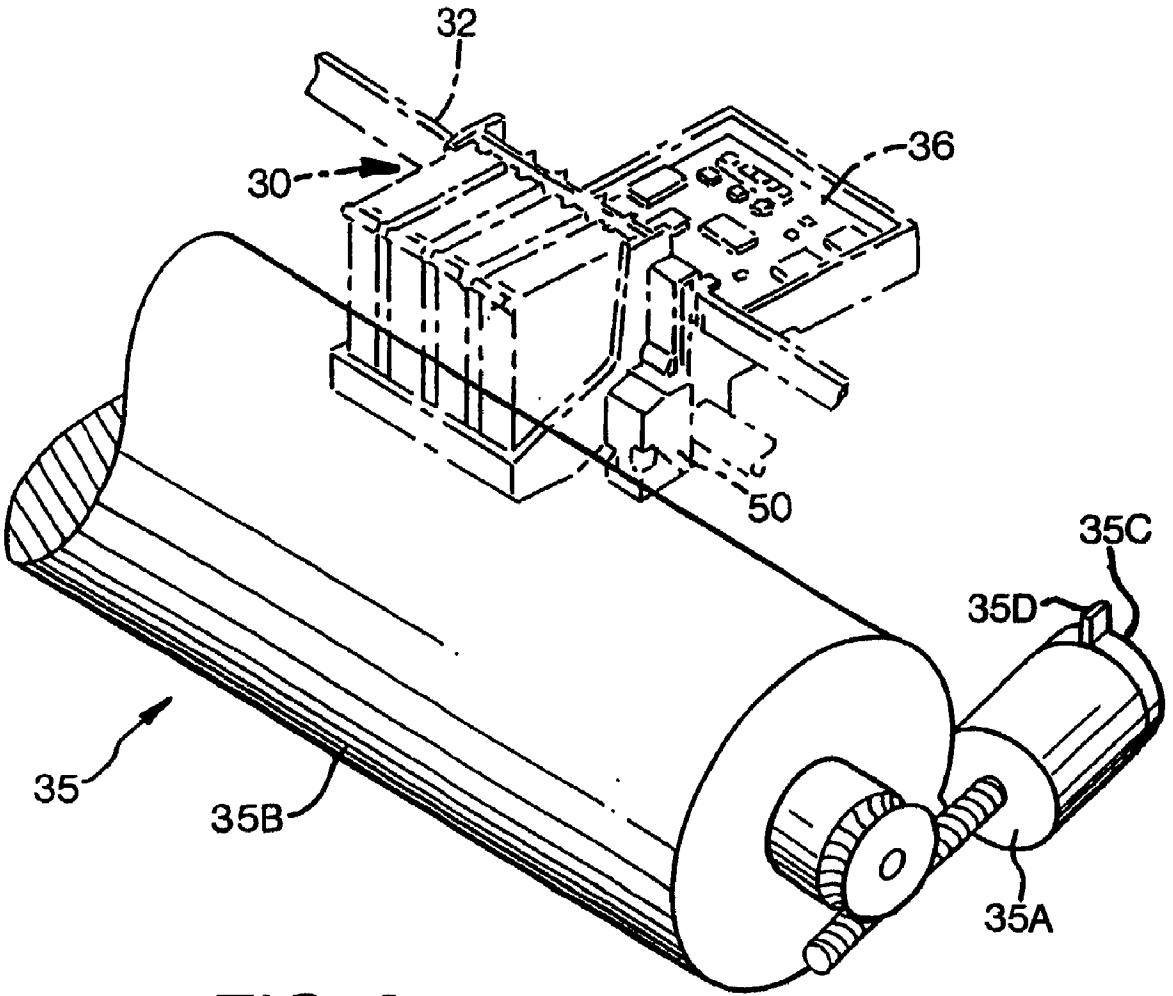
FIG. 3 is a close-up view of the platen portion of the printer/plotter of FIG. 1 showing the carriage portion in phantom lines.

FIG. 3 is a perspective view of a simplified representation of a media positioning system 35 which can be utilized in the inventive printer. The media positioning system 35 includes a motor 35A which is normal to and drives a media roller 35B. The position of the media roller 35B is determined by a media position encoder 35C on the motor. An optical reader 35D senses the position of the encoder 35C and provides a plurality of output pulses which indirectly determines the position of the roller 35B and, therefore, the position of the media 33 in the Y axis.

The media and carriage position information is provided to a processor on a circuit board 36 disposed on the carriage assembly 30.

The printer 10 has four inkjet print cartridges 38, 40, 42, and 44 that store ink of different colors, e.g., black, magenta, cyan and yellow ink, respectively. As the carriage assembly 30 translates relative to the medium 33 along the X and Y axes, selected nozzles in the inkjet print cartridges are activated and ink is applied to the medium 33. The colors from the three color cartridges are mixed to obtain any other particular color. Sample lines 46 are typically printed on the media 33 prior to doing an actual printout in order to allow the optical sensor 50 to pass over and scan across the lines as part of the initial calibration.

The carriage assembly 30 positions the inkjet print cartridges and holds the circuitry required for interface to the ink firing circuits in the print cartridges. The carriage assembly 30 includes a carriage 31 adapted for reciprocal motion on front and rear slider rods.

As mentioned above, full color printing and plotting requires that the colors from the individual print cartridges be precisely applied to the media. This requires precise alignment of the print cartridges in the carriage. Unfortunately, paper slippage, paper skew, and mechanical misalignment of the print cartridge results in offsets in the X direction (in the media advance axis) and the Y direction (in the carriage or axis) as well as angular theta offsets. This misalignment causes misregistration of the print images/graphics formed by the individual ink drops in the media. This is generally unacceptable in multi-color printing.

Figure 4:
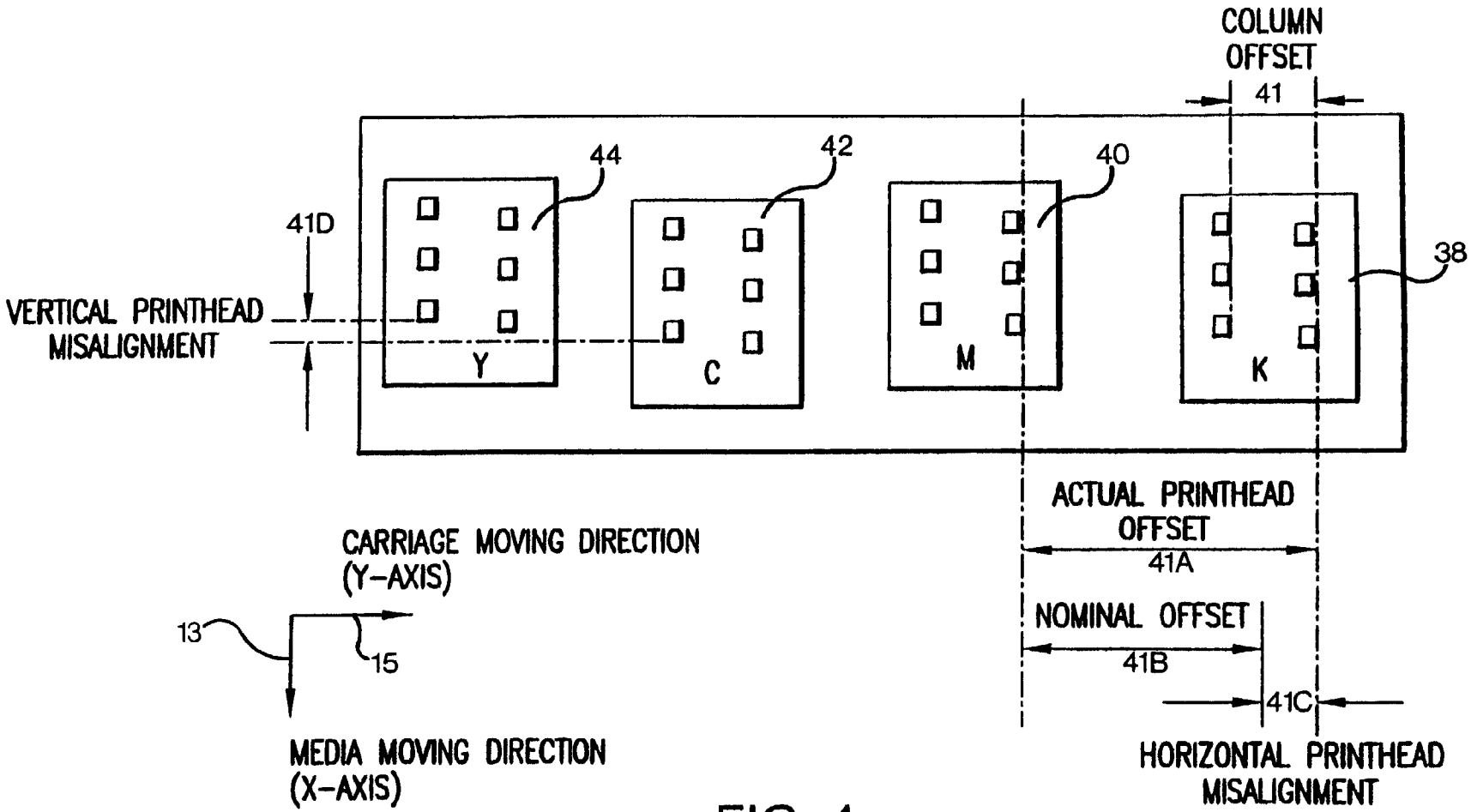
FIG. 4 is a schematic representation of a top view of a carriage showing offsets between individual printheads in the media advance axis and in the carriage scan axis.

FIG. 4 shows a presently preferred embodiment of printheads 38, 40, 42, 44 each having two groups of nozzles with a column offset 41. By comparing the relative positions of corresponding nozzles in different printheads along the Y axis, it is possible to determine an actual horizontal offset 41A between two printheads, and by comparison with a nominal default offset 41B determine an actual offset 41C in the carriage scan axis. This is repeated for all of the different printheads while they remain on the carriage.

Similarly, by comparing the relative positions of corresponding nozzles in different printheads along the X axis, it is possible to determine an actual vertical offset 41D in the media advance axis. This is also repeated for all of the different printheads while they remain on the carriage.

Figure 5:
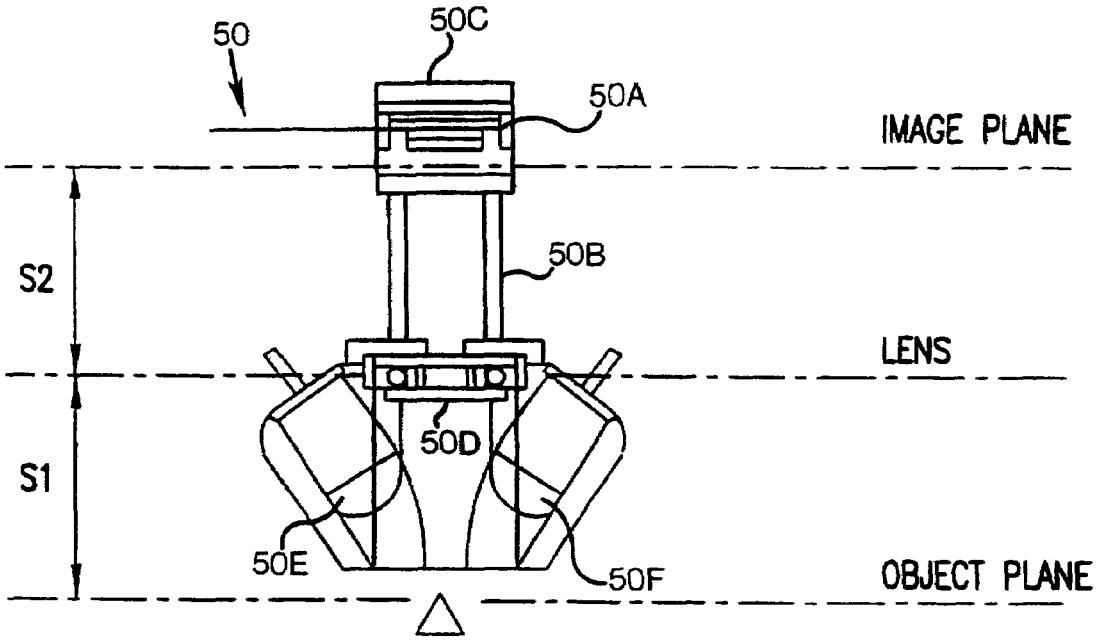
FIG. 5 is a front view of the optical components of the sensor unit of FIG. 4.
Figure 7:
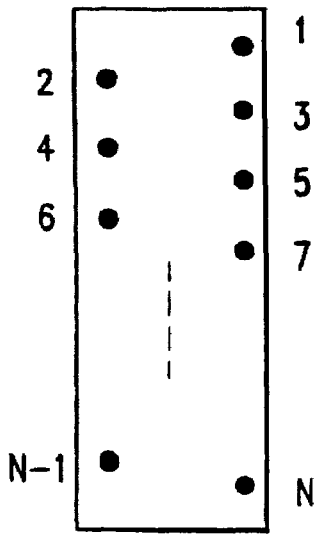
FIG. 7 schematically shows the nozzle plate of a 600 dpi print carriage having one column of ink-ejection nozzles separated from another column of ink-ejection nozzles.
Figure 8:
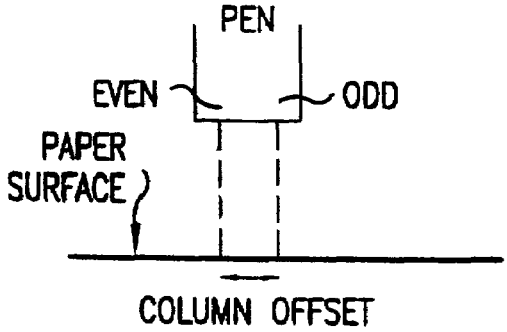
FIG. 8 schematically shows the print cartridge of FIG. 7 in printing position over a print zone.
Figure 6B:
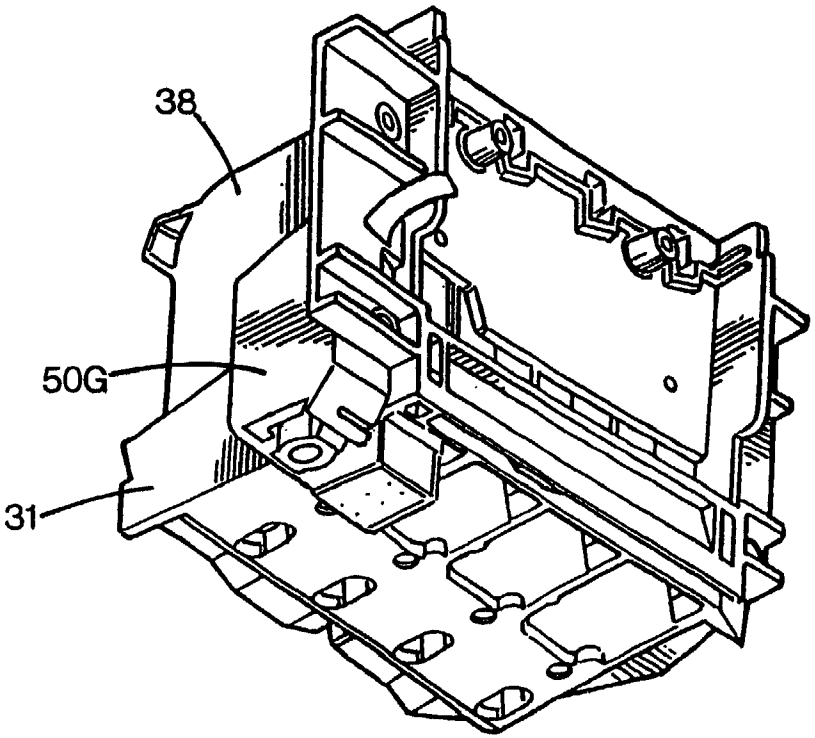
FIGS. 6A and 6B are isometric views respectively looking downwardly and upwardly toward the carriage showing the optical sensor and one print cartridge mounted on the carriage.
Figure 6A:
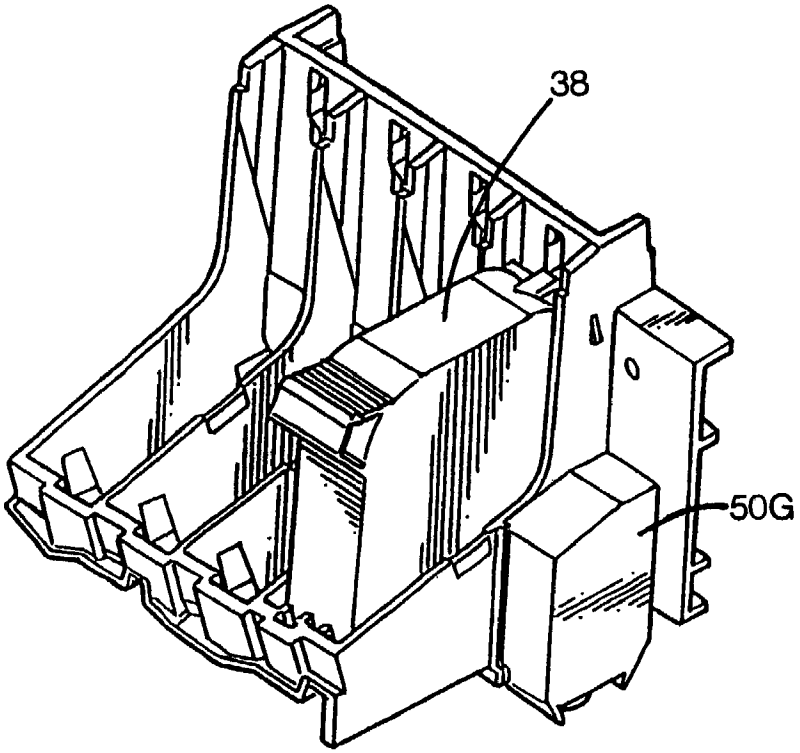

In order to accurately scan across a test pattern line, the optical sensor 50 is designed for precise positioning of all of its optical components. Referring to FIGS. 5, 6A and 6B, the sensor unit includes a photocell 50A, holder 50B, cover 50C, lens 50D; and light source such as two LEDs 50E, 50F. A protective casing 50G which also acts as an ESD shield for sensor components is provided for attachment to the carriage.

Additional details of the function of a preferred optical sensor system and related printing system are disclosed in corresponding application Ser. No. 08/551,022 filed 31 Oct. 1995 entitled OPTICAL PATH OPTIMIZATION FOR LIGHT TRANSMISSION AND REFLECTION IN A CARRIAGE-MOUNTED INKJET PRINTER SENSOR, which application is assigned to the assignee of the present application, and is hereby incorporated by reference.

In an exemplary embodiment of the invention, a diagnostic print mode is employed that prints different areas of the plot at different passes with a controlled amount of advances between them. This can readily be implemented by use of a special print mode mask. Print mode masks are well known in the ink jet art, and particularly in multi-pass printing, wherein a plurality of carriage passes are employed to print the area subtended by the printhead nozzle array. FIG. 9 illustrates a simple print mask 100, as a rectilinear grid of pixels, with each pixel location having a number associated therewith, the number representing the pass in which the pixel will be printed. The mask 100 is for an exemplary 8 pass print mode. For this exemplary mask, the first pixel or dot of the first row will be fired in pass 5, the second dot of the first row in pass 6, and so on. Mask 100 is a five-pixel-by-five-pixel mask, for simplicity in illustrating masks, but it will be understood that other mask sizes can be employed, and in fact much larger masks are typically employed.

Consider the case in which it is desired to observe the accumulated media advance error after n advances, where p>n is the number of passes in the print mode. The number of advances will typically equal the number of passes minus one. In eight passes, for example, the media will have undergone several advances before a given area is covered. The mask could be defined so that the distance in advances between two adjacent pixels is less than the total advances, but it will never be more because all the pixels have to be printed after the total number of passes over them has been executed.

Define w to be the width of the mask, i.e the number of pixels in a row of the mask. If $a_i$ is a pass number in row i of the mask, and $b_i$ the pass number that will print n passes after $a_i$ in that particular row, row i of the mask would be $$a_i \ldots (w/2) \ldots a_i, b_i, \ldots (w/2) \ldots b_i$$

Thus, the first w/2 pixels in the row are printed in the same pass ($a_i$), and the last w/2 pixels in the row are printed in another pass ($b_i$). Note that $a_i$ and $b_i$ depend on the section of the mask, and thus for different sections, i.e. different regions of the mask containing several passes, different passes will be applied.

In the following examples, the masks are specified by assigning to each pixel the pass number in which it will be printed. The printhead is assumed to hold a counter of pass numbers, and to fire wherever the pass number assigned to the pixel corresponds to the value on the printhead's counter, typically implemented on the printer controller. An alternative counting approach is to count as if the counter is associated with the print medium, e.g. pass 3 is the third time a particular pixel sees the printhead above. The printhead is moved incrementally from above the mask; i.e. for the first pass, only the lower section of the printhead nozzle array is situated above the mask, for the second pass (after the first advance of the print medium) the two lower sections of the printhead are above the mask and firing, and so on.

Consider now a four pass example. This four pass mask (p=4) of width w=4 will pick up the accumulated advance error after three passes (n=3) of a printhead with eight nozzles arranged in a column oriented transversely to the carriage scan axis of the printer. A constant advance of two nozzles between passes is assumed:

| | | | |
|---|---|---|---|
| 1 | 1 | 4 | 4 |
| 1 | 1 | 4 | 4 |
| 2 | 2 | 1' | 1' |
| 2 | 2 | 1' | 1' |
| 3 | 3 | 2' | 2' |
| 3 | 3 | 2' | 2' |
| 4 | 4 | 3' | 3' |
| 4 | 4 | 3' | 3' |

For the four pass example, then, the first two pixels of each of the first and second rows are fired in the first pass (1) of the first set of passes, and the last two pixels of the first and second rows are fired in the fourth pass (4), i.e. after the printhead has been moved incrementally three times, with a two nozzle advance distance between passes. For the next two rows, the first two pixels are fired in the second pass (2), and the last two pixels are fired in the first pass (1') of the next set of passes, i.e. after the first four passes, the pattern is repeated. For the subsequent two rows, the first two pixels are fired in the third pass (3) of the first set, and the last two pixels in the second pass (2') of the second set. For the last two rows, the first two pixels are fired in the fourth pass (4) of the first set, and the last two pixels in the third pass (3') of the second set. Errors caused by the media advance system will be more easily seen, since pixels in the same row are printed with the error effects introduced by three advances. For any given row, the pattern can be printed with four passes.

Figure 10B:
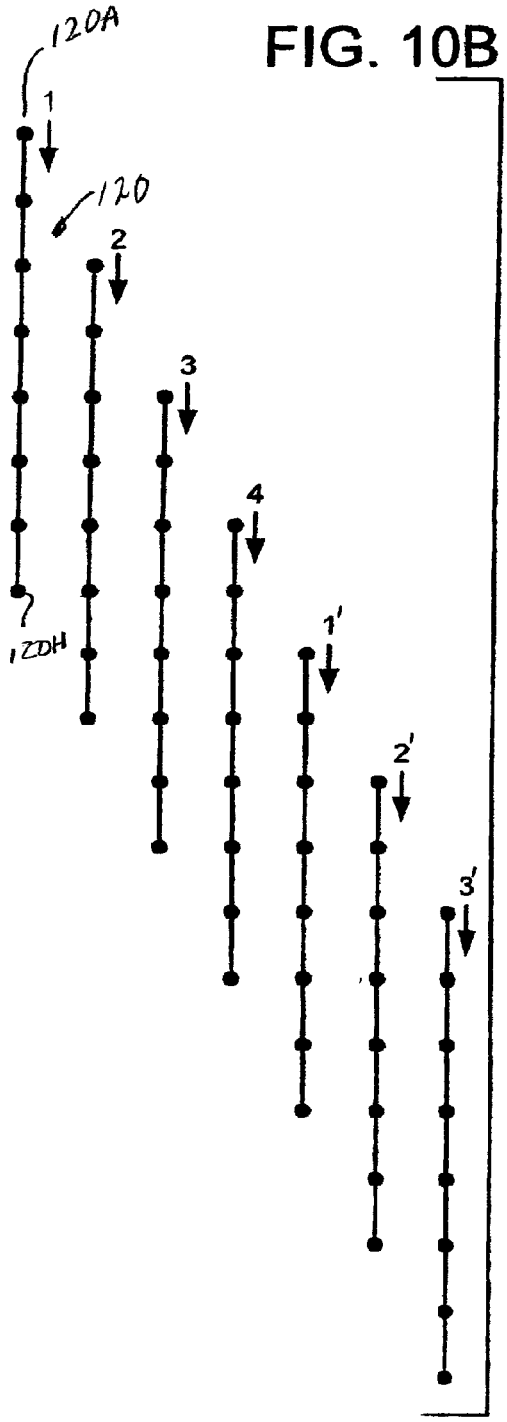
FIG. 10B diagrammatically depicts relative positions of a nozzle array relative to the print medium when printing using the mask of FIG. 10B.

The foregoing four pass example is further illustrated in FIGS. 10A-10D. FIG. 10A shows print mask 110, with the different numbers at each pixel location representing the pass number in which the pixel will be printed, i.e. the first set of passes 1, 2, 3, 4, and the first three passes 1', 2', 3' of the next set of passes.

FIG. 10B shows the relative X-axis location of the eight-nozzle printhead 120, with nozzles 120A-120H, for the seven successive passes needed to print the pixels in the mask 110, i.e. passes 1-4 of the first set of passes and passes 1'-3' of the second set of passes. It will be seen from FIG. 10B that there is a two nozzle incremental advance, achieved typically by moving the print medium along a media advance axis, between passes.

Figure 10C:
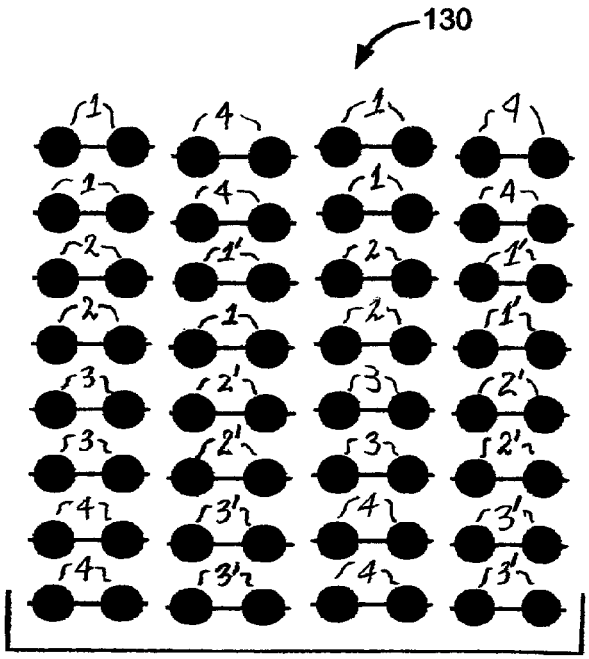
FIG. 10C illustrates a diagnostic pattern printed using the mask of FIG. 10A.

FIG. 10C shows the pattern 130 printed using the mask 110, replicated twice in the carriage scan axis direction. Each pixel or dot has a reference number 1, 2, 3, 4, 1', 2' or 3', indicating in which of the seven passes the pixel was printed. Thus, the first two pixels of the first two rows are printed in pass 1, the second two pixels in pass 4, the third two pixels in pass 1, and the last two pixels in pass 4. The first two pixels in the third and fourth rows are printed in pass 2, the second two pixels in pass 1', the third two pixels in pass 2, and the fourth two pixels in pass 1'. The first two pixels in the fifth and sixth rows are printed in pass 3, the second two pixels in pass 2', the third two pixels in pass 3, and the fourth two pixels in pass 2'. The first two pixels in the seventh and eighth rows are printed in pass 4, the second two pixels in pass 3', the third two pixels in pass 4, and the fourth two pixels in pass 3'. Thus, each row includes sets of pixels printed with advance error accumulated over three advances relative to other sets of pixels in the same row. An exemplary advance error accumulated over three advances is visible in FIG. 10C as a jaggedness in the rows.

Figure 10D:
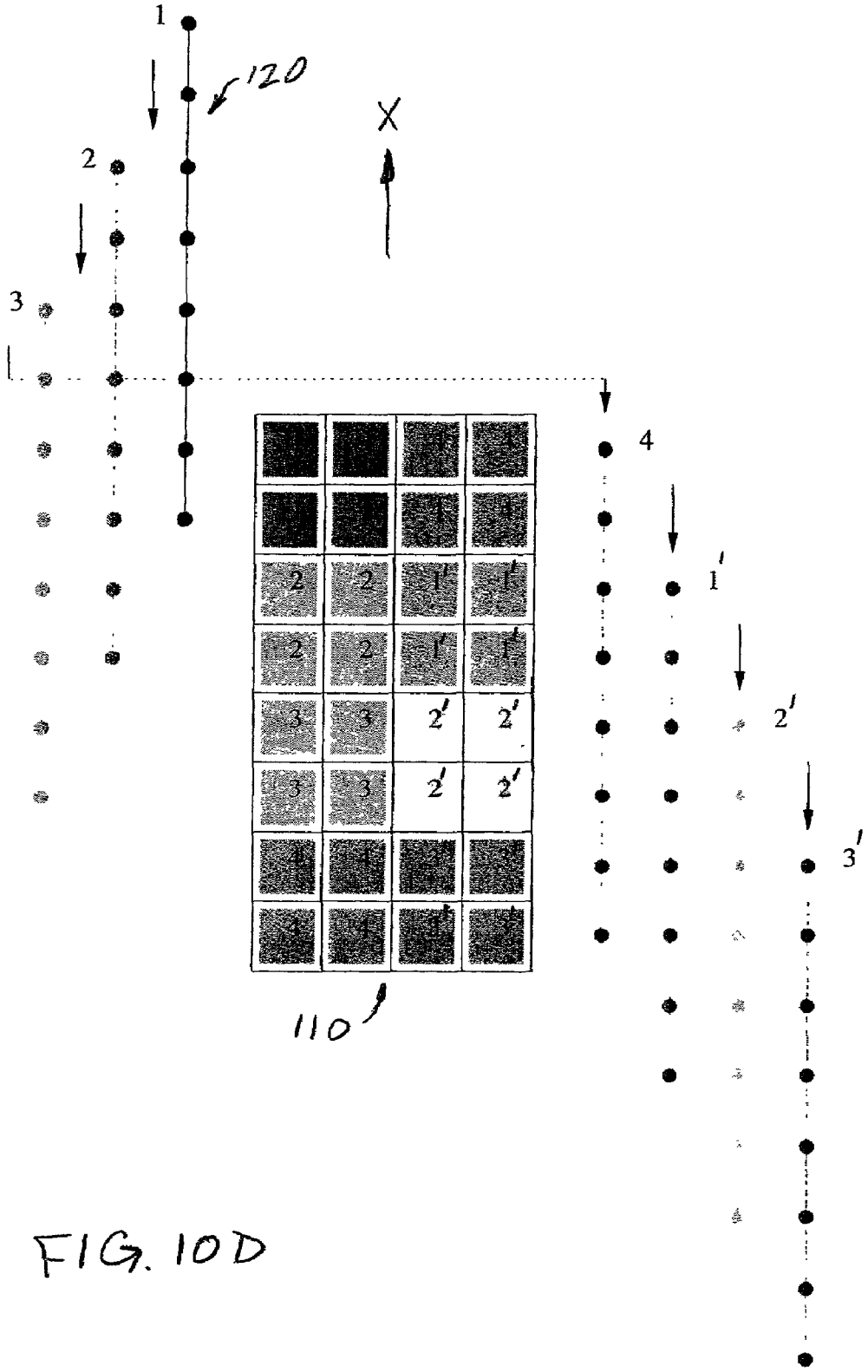
FIG. 10D diagrammatically depicts in a single figure the relative positions of the nozzle array relative to the print medium and the mask of FIG. 10A.

FIG. 10D further illustrates the vertical orientation of the printhead 120 in relation to the pixels printed during the successive passes 1-4 and 1'-3'. Here the printhead 120 is shown for each successive pass in its position relative to the print media and the mask 110, with the mask indicating which nozzles are fired for each pass.

Typically, in a color printer employing a black ink printhead as well as respective printheads for cyan, magenta and yellow inks, the pattern 130 can be printed using the black ink printhead, although this is not a requirement, and one or more of the printheads can be employed to print the pattern 130.

Now consider an eight pass example. This eight pass mask (p=8) of width w=4 will pick up the accumulated advance error after seven passes (n=7) of a printhead nozzle array with eight nozzles, assuming a constant advance (between passes) of one nozzle:

| | | | |
|---|---|---|---|
| 1 | 1 | 8 | 8 |
| 2 | 2 | 1' | 1' |
| 3 | 3 | 2' | 2' |
| 4 | 4 | 3' | 3' |
| 5 | 5 | 4' | 4' |
| 6 | 6 | 5' | 5' |
| 7 | 7 | 6' | 6' |
| 8 | 8 | 7' | 7' |

Here, the first two pixels of the first row are printed in the first pass, and the last two pixels are printed in the eighth pass, and thus the accumulated advance error of seven advances will appear in the first row. For each successive row, the last two pixels are printed seven passes after the first two pixels have been printed, so that the accumulated advance error of seven advances will appear. Thus, 1' indicates firing a pixel in the first pass of the second set of passes, and so on, as with the four pass embodiment discussed above.

Now consider another eight pass mask example. This eight pass mask (p=8) of width w=4 will pick up the accumulated advance error after five passes (n=5) of a printhead with eight nozzles, assuming a constant advance (between passes) of one nozzle, and is therefore less sensitive than the first eight pass print mask example:

| | | | |
|---|---|---|---|
| 1 | 1 | 6 | 6 |
| 2 | 2 | 7 | 7 |
| 3 | 3 | 8 | 8 |
| 4 | 4 | 1' | 1' |
| 5 | 5 | 2' | 2' |
| 6 | 6 | 3' | 3' |
| 7 | 7 | 4' | 4' |
| 8 | 8 | 5' | 5' |

Different plots can be printed with the above print modes in order to enhance the effect of dot placement error caused by accumulated media advance error, while diminishing the effect of dot placement error due to the nozzles. A good option is to print horizontal lines, with a small mask width (say eight 600 dpi pixels). Accumulated media advance error will make the lines look jagged. This is illustrated (for a mask width of four pixels) in FIG. 10C. If the horizontal lines are broken into a stair step, each step of a width of, say 20 times the mask width, and a vertical distance of, say two 600 dpi pixels between steps, the different steps will be printed with different nozzles, and thus will minimize the effect of defective nozzles. Moreover, if a vertical array of these stair-stepped lines is made, with a vertical separation between them equal to the media advance, all the steps of a given column will be printed with the same nozzles. This makes for a very robust diagnostic. If a column looks defective, it can be attributed to a defective nozzle. Only if a whole horizontal line looks defective, this can be attributed to media advance errors. The horizontal lines can be made of different thicknesses. In an exemplary embodiment, a thickness of two pixels gives good results.

Figure 11:
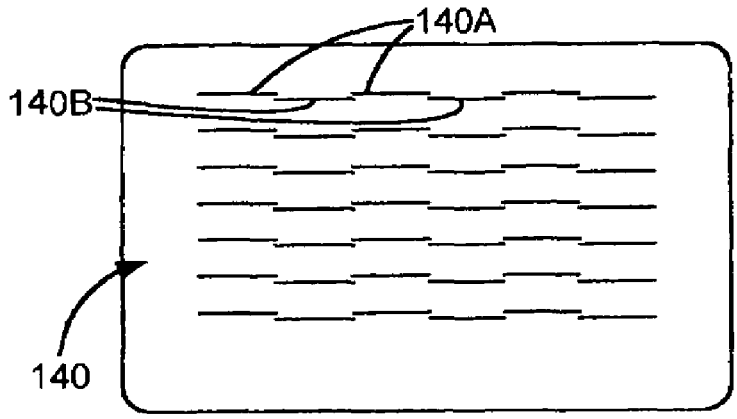
FIG. 11 illustrates an exemplary pattern in which each row is printed using a first set of pixels during a first pass and a second set of pixels is printed during a subsequent pass, with multiple media advances between the first pass and the subsequent pass.

Using a wider mask will make the lines look "broken" instead of jagged, and it also allows a good detection. FIG. 11 illustrates a pattern 140, where each row is printed using a first relatively wide set of pixels 140A (say sixty 600 dpi pixels) during a first pass and a second relatively wide set of pixels 140B printed during a subsequent pass, with multiple media advances between the first pass and the subsequent pass. Media advance error will create vertical "lines" at the boundaries between the line segments, i.e. in the middle of the mask.

Another good option is to make the mask wide (say sixty 600 dpi pixels) and unbroken horizontal lines very close together (a distance of, say, two 600 dpi pixels). This creates a vertical line in the middle of the mask in case of media advance errors.

Figure 12:
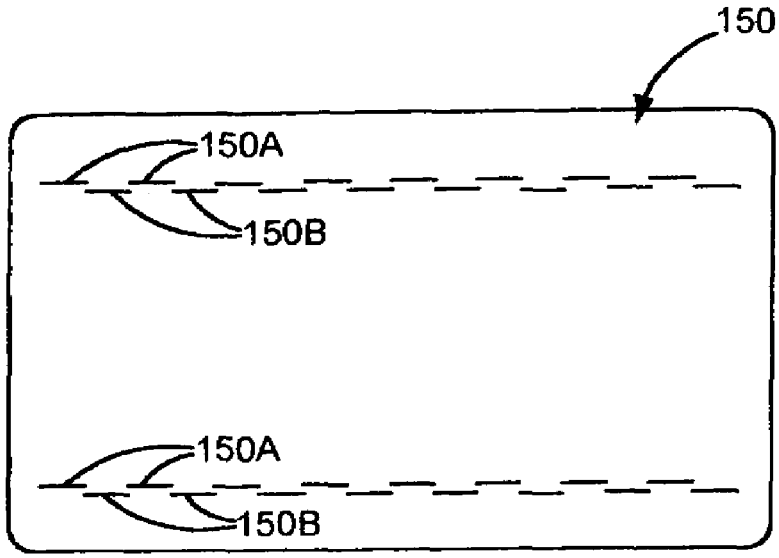
FIG. 12 illustrates an exemplary pattern of separated lines, each line printed using a wide mask, with one set of pixels printed during a first pass, and a second set printed during a subsequent pass, with multiple media advances between the first and subsequent passes.

FIG. 12 shows another pattern 150 of separated lines, each one or two pixels wide. As with the pattern 140 of FIG. 11, each line is printed using a wide mask, with one set of pixels 150A printed during a first pass, and a second set 150B printed during a subsequent pass, with multiple media advances between the first and subsequent passes. Each line is one or two pixels wide. The lines are separated by a relatively large distance so that they appear as distinct lines.

Figure 13:
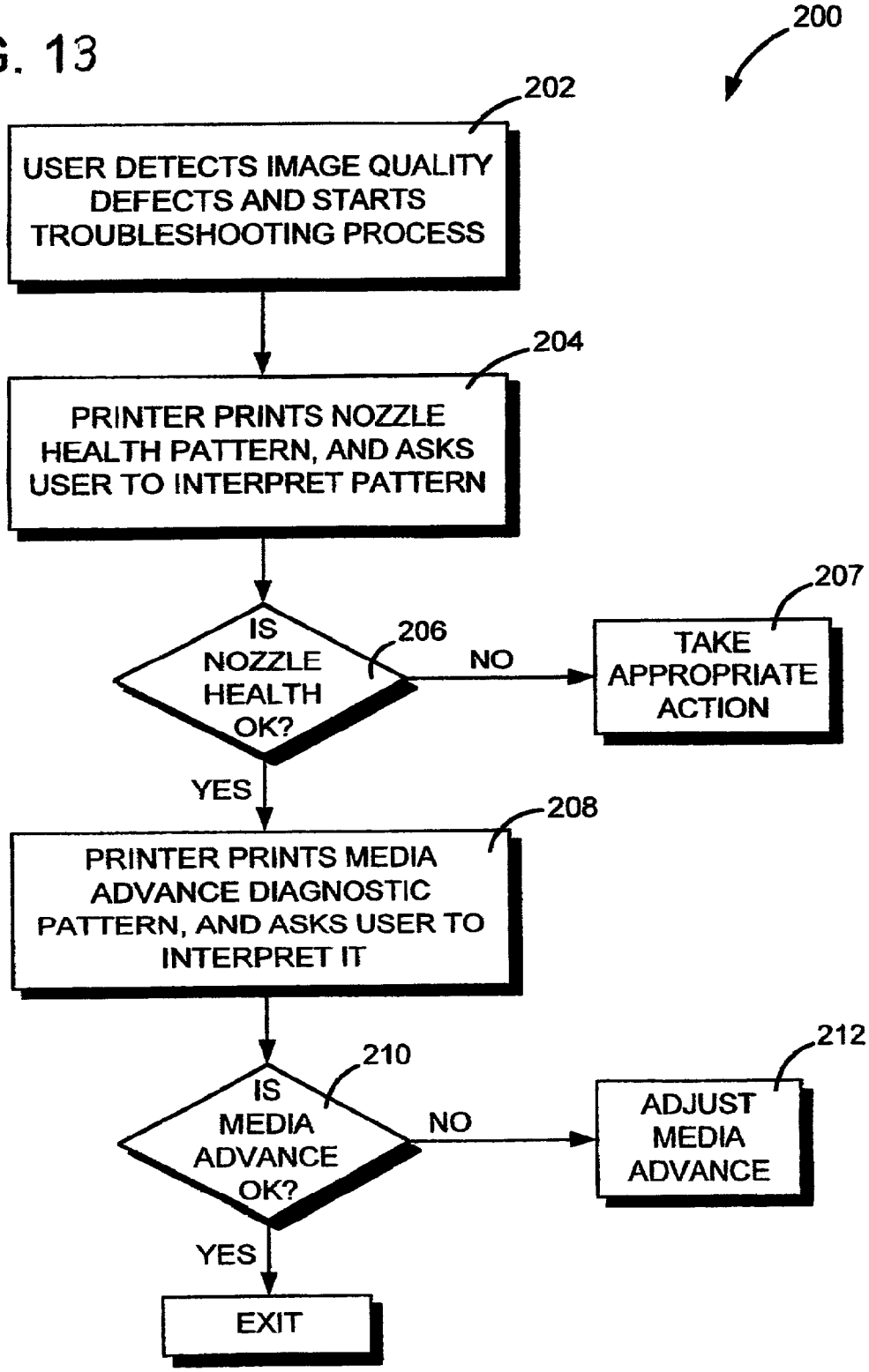
FIG. 13 is an exemplary flow diagram of a diagnostic algorithm in accordance with aspects of the invention.

The diagnostic technique can be incorporated in a printing device such as the system 10 described above with respect to FIGS. 1-8. In this system, an algorithm can be included in the controller firmware or software to carry out the printing of the diagnostic pattern described above. FIG. 13 is a flow diagram of an exemplary diagnostic algorithm 200. The printer is instructed at 200 to carry out the printing of a diagnostic pattern. In this exemplary embodiment, this instruction comes about because the user has detected some image quality defects, and starts a trouble shooting process. Alternatively, the printing system can be programmed to carry out this algorithm automatically, e.g. on powerup. Moreover, in a further alternate embodiment, the reading of the pattern be done automatically by the system optical sensor, and the detected defects compared against some threshold parameters to automatically determine whether servicing of the paper advance is required.

At 204, the printer 10 prints a nozzle health pattern, and asks the user to interpret the pattern. A nozzle health pattern is a special diagnostic plot that allows the user to discern whether the printhead nozzles are healthy. This allows the user to determine, before proceeding to print the media advance diagnostic pattern, whether the nozzle health can be ruled out as the source of the print quality problem. Printing a nozzle health pattern is not the only way to determine whether the printhead nozzles have a problem; some printers can detect the health of the nozzles using automated techniques. If the nozzles are not healthy, then at step 207, appropriate actions are taken to recover the printhead nozzle health, and no media advance calibration will be undertaken, in this exemplary embodiment, unless print quality problems persist. Such recovery actions are known, e.g. nozzle array wiping and spitting routines at a printhead service station. Of course, the printheads may need replacing if the nozzle health can not be recovered.

If the nozzle health is determined to be acceptable, then the printer prints the media advance diagnostic pattern and asks the user to interpret the resulting pattern. If at 210 the errors are unacceptable, the media advance system is adjusted at 212. This adjustment can be performed by a technician in some applications. Alternatively, the user can perform some adjustments in other applications.

Figure 14:
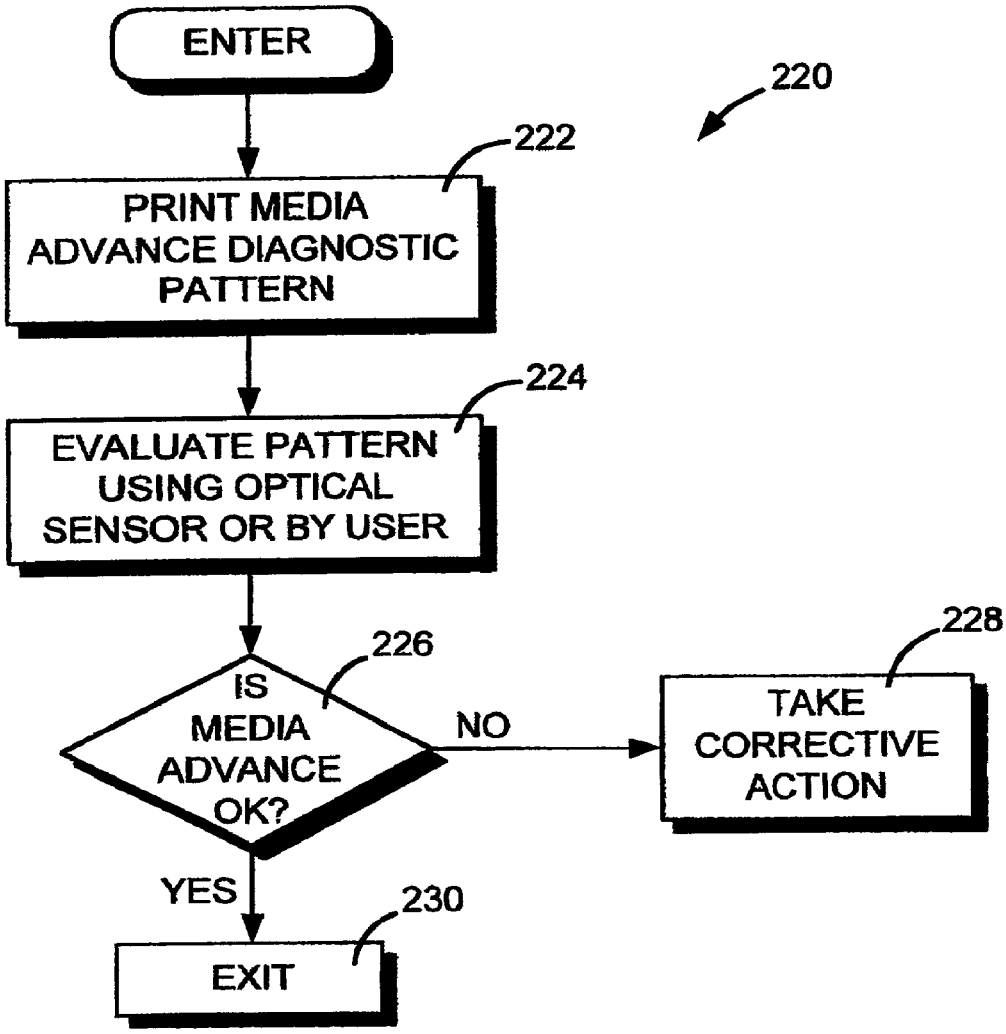
FIG. 14 is an exemplary flow diagram of an alternate diagnostic algorithm in accordance with aspects of the invention.

FIG. 14 is a simplified flow diagram illustrating an automated diagnostic technique in accordance with aspects of the invention. In this case, the algorithm 220 is periodically entered, say on powerup or after changing a printhead and performing a printhead alignment algorithm. At step 222, the media advance pattern 130 is printed. The system then automatically evaluates the pattern using the system optical sensor to detect the locations of the marks comprising the pattern, and determine whether the deviation of the measured locations of marks such as the marks on row number 1 are within some predetermined threshold. Once the threshold is exceeded, then at 226 operation branches to step 228 to take appropriate corrective action, as described above. If the media advance errors are within the prescribed threshold or tolerance, at step 226, then the algorithm is exited at 230. While not shown in FIG. 14, a nozzle health test can be performed before printing the pattern 130.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A diagnostic method for visual detection of poor media advance calibration in an ink-jet printing system, comprising:

entering a diagnostic mode of the printing system in which mode normal printing jobs of the printing system are not printed;

printing different areas of a diagnostic pattern at different passes of one or more ink-jet printheads with a controlled amount of media advances between the passes, to accumulate media advance error between the printing of the different areas; and examining the diagnostic pattern to determine whether the accumulated media advance error is sufficiently objectionable to take corrective action; and wherein said printing different areas comprises:

printing a first area comprising a first set of pixels printed during a first pass;

conducting a plurality of incremental media advances;

printing a further area comprising a second set of pixels printed during a further pass, wherein said different areas are nominally aligned along a horizontal line, and wherein media advance errors resulting from said plurality of media advances are accumulated between printing said first area and printing said further area.

2. The method of claim 1, wherein said step of examining the diagnostic pattern is conducted visually by a user.

3. The method of claim 1, wherein said step of examining the diagnostic pattern is conducted by an optical sensor comprising the printing system.

4. The method of claim 1, wherein said step of printing different areas of a diagnostic plot includes:

applying a diagnostic multi-pass print mode mask, wherein a plurality of carriage passes are employed to print the area subtended by a printhead nozzle array, the diagnostic print mode mask comprising a rectilinear grid of pixels, with each pixel location having a number associated therewith, the number representing the pass in which the pixel will be printed, and wherein said different areas include a first set of pixels on a row of said grid, and a second set of pixels on said row, and wherein said first set of pixels is printed on a different pass than said second set of pixels is printed.

5. A diagnostic method for visual detection of poor media advance calibration in an ink-jet printing system, comprising:

providing an ink-jet printhead mounted on a carriage, the carriage mounted for movement along a scan axis;

providing a media advance system for advancing a print medium along a media path which is transverse to the scan axis;

entering a diagnostic multi-pass print mode in which mode normal printing jobs of the printing system are not printed;

printing different areas of a diagnostic plot at different passes using said ink-jet printhead with a controlled amount of media advances between the passes to accumulate media advance error between the printing of the different areas; and examining the diagnostic plot to determine whether the accumulated media advance error is sufficiently objectionable to take corrective action; and wherein said printing different areas comprises:

printing a first area comprising a first set of pixels printed during a first pass;

conducting a plurality of incremental media advances;

printing a further area comprising a second set of pixels printed during a further pass, wherein said different areas are nominally aligned along a horizontal line, and wherein media advance errors resulting from said plurality of media advances are accumulated between printing said first area and printing said further area.

6. The method of claim 5, wherein said step of examining the diagnostic pattern is conducted visually by a user.

7. The method of claim 5, wherein said step of examining the diagnostic pattern is conducted by an optical sensor comprising the printing system.

8. The method of claim 5, wherein said step of printing different areas of a diagnostic plot includes:

applying a diagnostic multi-pass print mode mask, wherein a plurality of carriage passes are employed to print the area subtended by a printhead nozzle array, the diagnostic print mode mask comprising a rectilinear grid of pixels, with each pixel location having a number associated therewith, the number representing the pass in which the pixel will be printed, and wherein said different areas include a first set of pixels on a row of said grid, and a second set of pixels on said row, and wherein said first set of pixels is printed on a different pass than said second set of pixels is printed.

* * * * *